US006971449B1

(12) United States Patent
Robertson

(10) Patent No.: US 6,971,449 B1
(45) Date of Patent: Dec. 6, 2005

(54) BOREHOLE CONDUIT CUTTING APPARATUS AND PROCESS

(75) Inventor: Michael C. Robertson, Burleson, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/304,653

(22) Filed: May 4, 1999

(51) Int. Cl.[7] ..... E21B 43/117
(52) U.S. Cl. ..... 166/297; 166/55; 166/63
(58) Field of Search ..... 166/55, 55.2, 63, 166/72, 297, 298

(56) References Cited

U.S. PATENT DOCUMENTS

| | | | | |
|---|---|---|---|---|
| 2,506,799 A | | 5/1950 | Livingston | |
| 2,535,964 A | | 12/1950 | Stanton | |
| 2,587,244 A | | 2/1952 | Sweetman | |
| 2,758,543 A | | 8/1956 | Grandin | |
| 4,298,063 A | | 11/1981 | Regalbuting et al. | |
| 352,397 A | * | 10/1982 | Christopher | 166/297 |
| 4,598,769 A | | 7/1986 | Robertson | |
| 4,798,244 A | * | 1/1989 | Trost | 166/250 |
| 4,799,829 A | | 1/1989 | Kenny | 405/195 |
| 4,905,759 A | | 3/1990 | Wesson et al. | 166/55 |
| 4,960,171 A | | 10/1990 | Parrott et al. | 166/55 |
| 5,135,050 A | | 8/1992 | Tailby | 166/99 |
| 5,435,394 A | | 7/1995 | Robertson | |
| 5,636,692 A | | 6/1997 | Haugen | 166/298 |
| 5,690,171 A | * | 11/1997 | Winch et al. | 166/63 |
| 5,709,265 A | | 1/1998 | Haugen et al. | 166/55.2 |
| 5,791,417 A | * | 8/1998 | Haugen et al. | 166/298 |
| 5,813,465 A | | 9/1998 | Terrell et al. | |
| 5,862,862 A | | 1/1999 | Terrell | |
| 6,016,753 A | | 1/2000 | Glenn et al. | 102/307 |
| 6,024,169 A | | 2/2000 | Haugen | 166/298 |
| 6,035,935 A | | 3/2000 | Regalbuto | 166/298 |
| 6,135,206 A | | 10/2000 | Gano et al. | |
| 6,202,752 B1 | | 3/2001 | Kuck et al. | 166/298 |

FOREIGN PATENT DOCUMENTS

| | | | |
|---|---|---|---|
| EP | 0 819 827 A2 | 1/1998 | E21B/29/06 |
| EP | 0 846 838 A2 | 6/1998 | E21B/29/02 |
| GB | 2177740 A | 1/1987 | E21B/29/02 |
| GB | 2346633 | 8/2000 | |
| WO | WO 97/21903 | 6/1997 | E21B/29/02 |
| WO | WO 99/64715 | 12/1999 | |
| WO | WO 00/50727 | 8/2000 | |
| WO | WO 00/66876 | 11/2000 | |

* cited by examiner

*Primary Examiner*—David Bagnell
*Assistant Examiner*—Zakiya Walker
(74) *Attorney, Agent, or Firm*—Moser, Patterson & Sheridan, L.L.P.

(57) ABSTRACT

The apparatus is used for cutting an opening through the wall of a conduit located in a borehole traversing the subsurface formations. The apparatus includes a body adapted to be lowered into the conduit to a desired level. The body is formed by a cylindrical wall defining an elongated chamber having a combustible charge receiving portion and an ignition portion located close to the combustible charge receiving portion. A plurality of spaced apart apertures are formed through the wall defining a given pattern which may be at least one elongated row of apertures generally parallel with the axis of the cylindrical wall or a line which encloses a given configuration on one side of the axis. A combustible charge is located in the combustible charge receiving portion of the chamber, and an ignition device is located in the ignition portion of the chamber for igniting the combustible charge for creating a flame and hot combustion products for passage through the apertures for cutting the wall of the conduit to form an opening through the wall of the conduit. In the preferred embodiment, the combustible charge is located in the chamber above, at the level and below the apertures.

23 Claims, 5 Drawing Sheets

BOREHOLE CONDUIT CUTTING APPARATUS AND PROCESS

BACKGROUND OF THE INVENTION

1. Field of the Invention

The invention relates to an apparatus and process for forming an opening through conduit located in a borehole formed in the earth.

2. Description of the Prior Art

U.S. Pat. Nos. 4,298,063, 4,598,769, and 5,435,394 disclose apparatus for cutting conduit located in a borehole formed in the earth. U.S. Pat. Nos. 4,598,769 and 5,435,394 are incorporated into this application by reference.

SUMMARY OF THE INVENTION

It is an object of the invention to provide a new and useful apparatus and process for cutting an opening in a conduit located in a borehole formed in the earth.

The apparatus of the invention comprises a body adapted to be lowered into the casing located in the borehole. The body comprises a surrounding wall defining an elongated chamber having a combustible charge receiving portion and an ignition means portion located close to the combustible charge receiving portion. A portion of the wall surrounding the combustible charge receiving portion has a plurality of spaced apart apertures formed therethrough in a given pattern. A combustible charge is located in the combustible charge receiving portion of the chamber. An ignition means is located in the ignition means portion of the chamber for igniting the combustible charge for creating a flame and hot combustion products for passage through the apertures for cutting an opening in the surrounding conduit.

The opening may be formed by burning an enlarged area through the conduit or by burning a slot through the conduit around a conduit wall portion which wall portion then is removed.

In the preferred embodiment, the combustible charges are located above, at the level of and below the apertures.

DESCRIPTION OF THE PREFERRED EMBODIMENTS

Figure 1A:
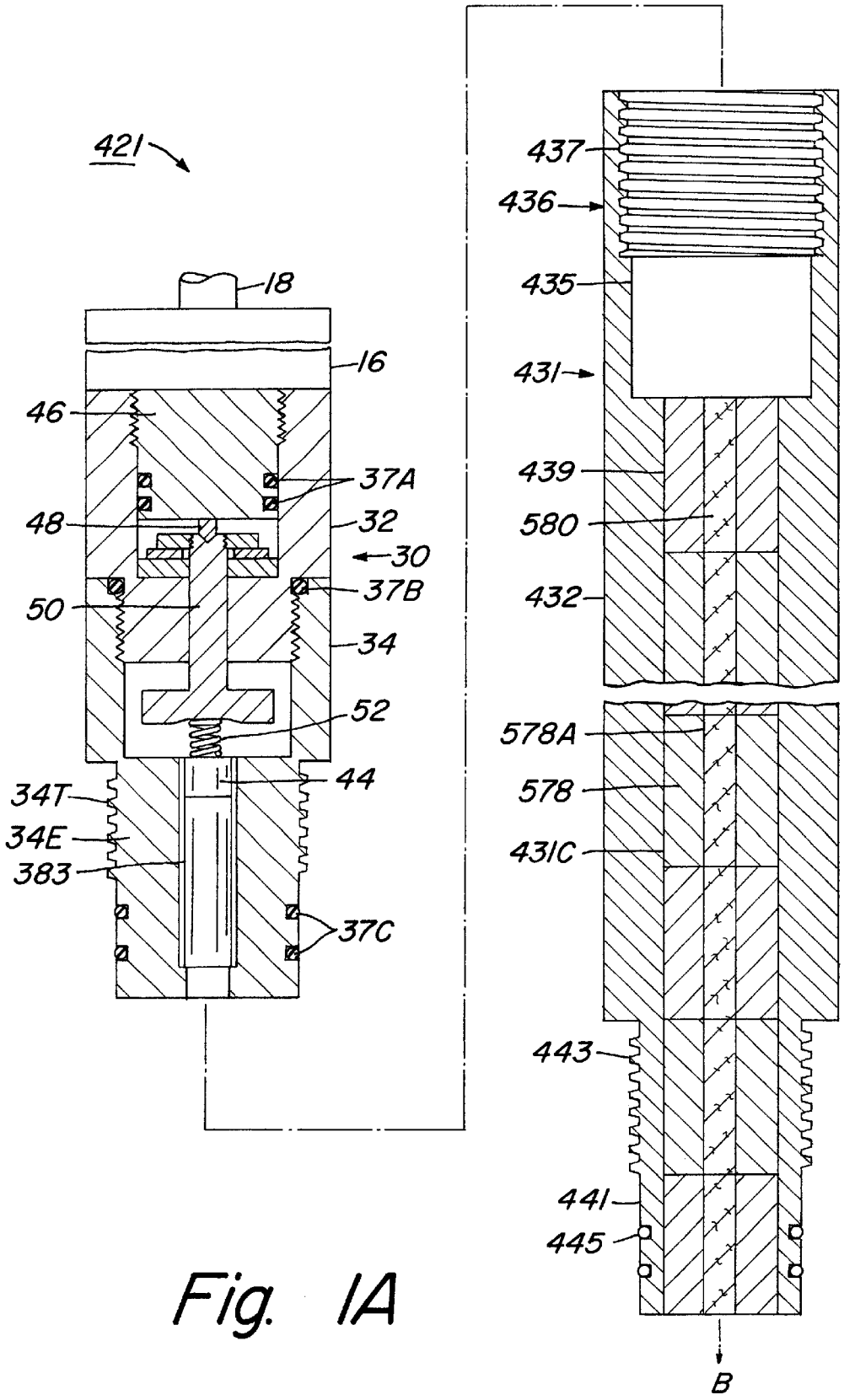
FIGS. 1A and 1B are an exploded cross-sectional view of the apparatus of the invention. The symbol B indicates that the lower end of the member on the right side of FIG. 1A is connected to the upper end of the member on the left side of FIG. 1B.
Figure 1B:
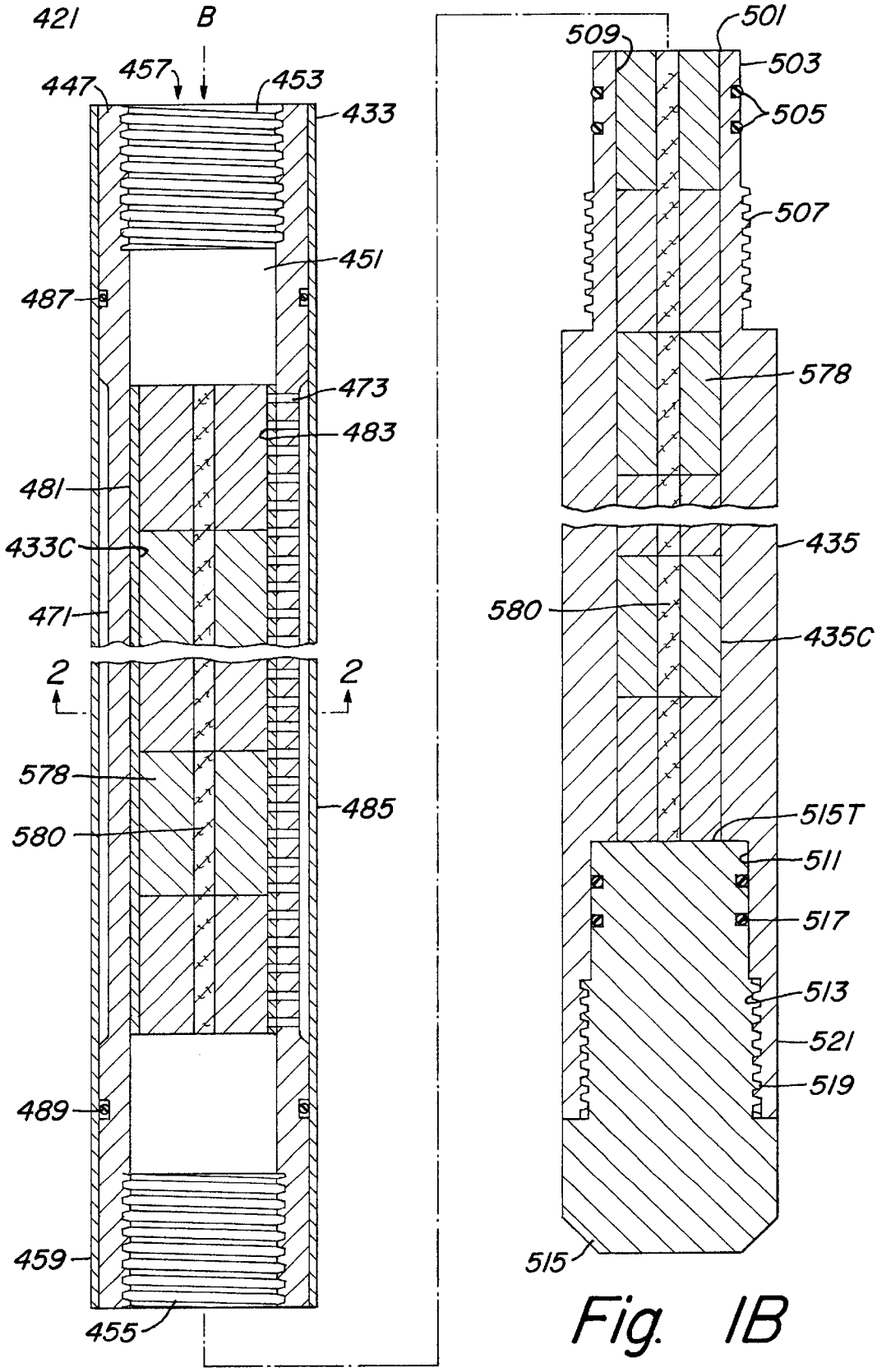

Referring now to FIGS. 1A and 1B, the apparatus of the invention is identified at 421. It comprises an anchor subassembly 16, an ignition means subassembly 30 comprising members 32 and 34, an upper combustible charge holding subassembly 431, a nozzle and intermediate combustible charge holding subassembly 433 and a lower combustible charge holding subassembly 435. Members 32, 34, 431, 433, and 435 are formed of suitable metal.

Figure 5:
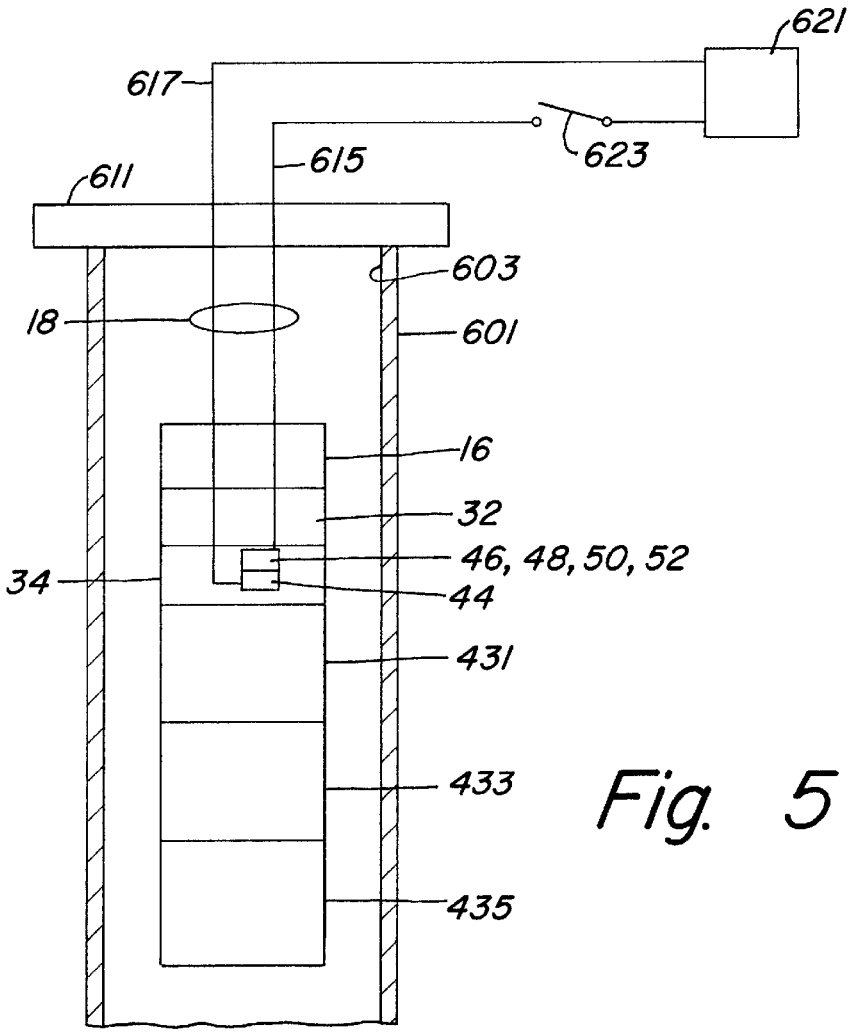
FIG. 5 is a schematic view of the apparatus of FIGS. 1A and 1B in a cased borehole.
Figure 4:
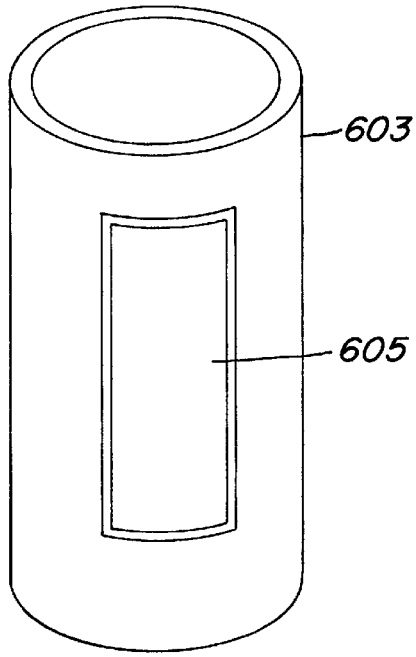
FIG. 4 is an isometric view of a portion of a borehole casing having a window cut through one side of its wall.

The anchor 16, and subassemblies 30, 431, 433, 435 are assembled as shown in FIG. 5 and lowered to a desired level into a borehole 601 that has been cased with metal casing 603 and operated to form an elongated window 605 or opening through the casing 603 as shown in FIG. 4 to allow access to the formation from the existing borehole for example to allow recovery of petroleum in the formations through the opening 605. The length of the opening 605 may be generally parallel to the central axis of the casing 603. Its length and width can vary.

The anchor subassembly 16 and the ignition subassembly 30 are similar to those disclosed in U.S. Pat. No. 4,598,769. The anchor subassembly 16 has a wireline cable 18 coupled to its upper end and has its lower end coupled to the ignition means subassembly 30. The ignition subassembly comprise metal members 32 and 34 screwed together with an electrode plug 46 coupled to member 32. The electrode 46 has a prong 48 which engages an electrical conductor 50 supported by the lower end of member 32. A metal spring 52 is disposed between the conductor 50 and an electrically actuated ignition means or squib 44 which is located in a small aperture 383 extending through the lower end 34E of member 34. Members 37A, 37B, and 37C are O-ring seals. The members 46, 48, 50 and 52 are electrically insulated to prevent a short. This ignition system may be defined as an electric line firing system.

Member 431 has annular wall 432 with an enlarged opening 435 at its upper end 436 with threads 437 leading to a smaller opening 439. The lower end 441 of member 431 has exterior threads 443 and O-ring seals 445.

Figure 2:
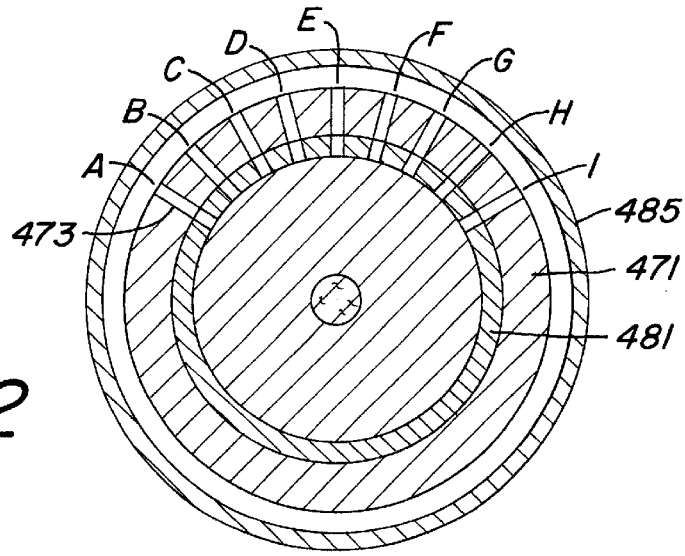
FIG. 2 is a cross-sectional view of FIG. 1B taken along lines 2—2 thereof.
Figure 3:
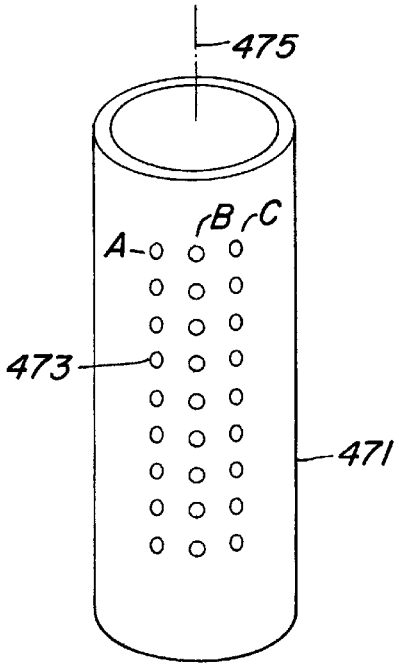
FIG. 3 is an isometric view of a portion of apparatus of FIGS. 1A and 1B.
Figure 6:
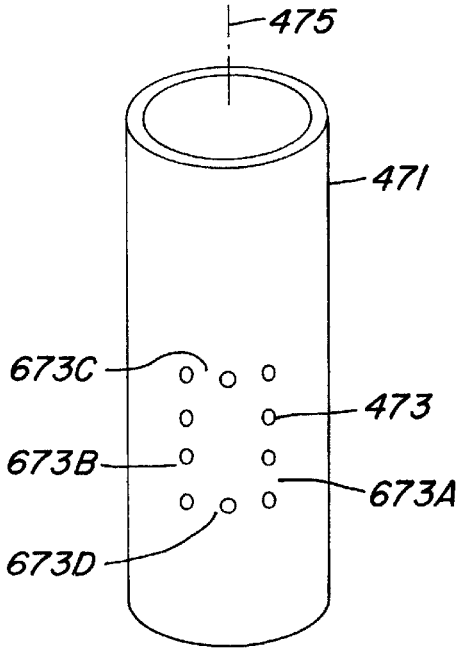
FIG. 6 is an isometric view of a portion of the apparatus of FIGS. 1A and 1B showing nozzle apertures located in a given pattern.
Figure 7:
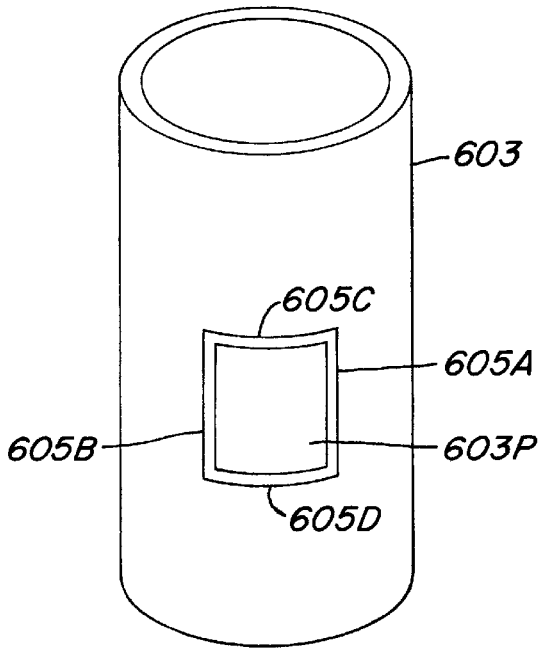
FIG. 7 is an isometric view of a portion of a borehole casing showing a window cut through one side of its wall with the resulting metal plug still in place.
Figure 8:
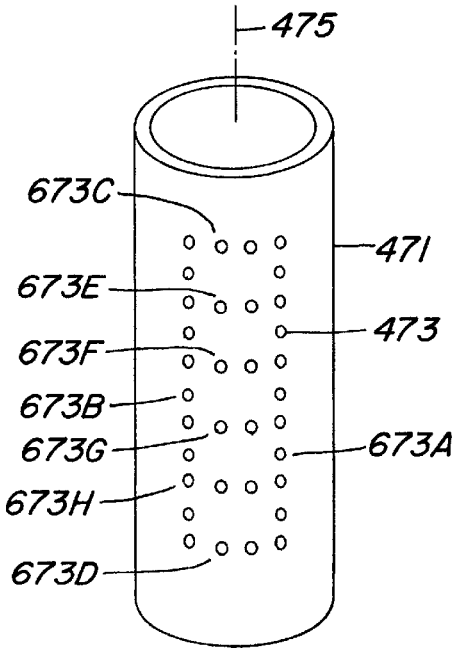
FIGS. 8 and 9 illustrate a different process of forming a window in the casing.

The nozzle subassembly 433 comprises an annular wall 447 with a cylindrical opening 451 formed therethrough with interior threads 453 and 455 at its upper and lower ends 457 and 459. The wall 447 comprises a wall section 471 having a smaller outside diameter than the ends 447 and 459. A plurality of rows of apertures 473 extend through the wall section 471 on one side thereof as shown in FIGS. 3, 6, and 8. In FIG. 3 there is shown three spaced apart rows A, B, C of apertures 473 with each row comprising a plurality of spaced apart apertures 473 and with each row being generally parallel to the axis 475 of the member 433. In FIG. 2, there is shown nine rows A–I of apertures 473. The number of rows and the length of the rows of apertures depend on the width and length of the window 605 to be formed in the casing 603 of the borehole 601.

Located on the inside of the wall section 471 is a hollow cylindrical shield 481 having apertures 483 formed therethrough which are aligned with the apertures 473. A thin metal sleeve 485 is secured around the outer wall 447 to prevent water from entering the apertures 473 and 483. Members 487 and 489 are O-ring seals.

The lower subassembly 435 comprises an annular wall 501 having an upper end 503 with O-ring seals 505 and exterior threads 507. A cylindrical aperture 509 extends into the member 435 to a larger diameter opening 511 having interior threads 513. A metal plug 515 with O-ring seals 517 and exterior threads 519 is inserted into the opening 511 and screwed into the lower end 521 of the member 435.

Also provided are a plurality of combustible pyrotechnic charges 578 made of conventional material which is compressed into donut shaped pellets. Each of the charges has a cylindrical outer surface and a central aperture 578A extending therethrough. The charges 578 are stacked on top of each other within the annular inside chamber portions 431C, 433C (inside of the carbon sleeve 481) and 435C with their apertures 578A in alignment. Loosely packed combustible material 580 preferably of the same material used in forming the charges 578 is disposed with the apertures 578A of the charges 578 such that each charge 578 is ignited from the loosely packed combustible material upon ignition by the ignition means 44.

In assembling the components 30, 431, 433, and 435, the threads 507 of end 501 of member 435 are screwed into threads 455 of the open end 459 of member 433; the threads 443 of end 441 of member 431 are screwed to the threads 453 of the open end 457 of member 433. During the assembly process, the charges 578 are stacked into the chamber portions 435C, 433C, and 431C of members 435, 433, and 431. The threads 34T of end 34E of assembled member 30 are screwed to the threads 437 of the open end 436 of the member 431. During the assembly process the charges 578 are stacked on each other from the top end 515T of the plug 515 and the material 580 placed in their apertures 578A.

The apparatus then is lowered into the borehole 601 and into the casing 603 by way of the cable 18 and uphole equipment illustrated at 611 in FIG. 5. The equipment 611 includes a reel around which the cable 18 is wound and unwound to raise and lower the apparatus 421. The cable 18 includes an electrically insulated electrical lead 615 which is coupled to the ignition means 44 by way of members 46, 48, 50 and 52 and an electrically insulated ground or return lead 617 coupled to the ignition means 44. An electrical power source 621 and a switch 623 are provided for applying electrical power to the ignition means 44 when the switch 623 is closed. The ignition means 44 includes an electrical resistor which generates heat when electrical current is applied thereto. Thus when switch 623 is closed, current is applied to the resistor of the ignition means 44, which generates enough heat to ignite the material 580 and hence the charges 578 to generate a very high temperature flame with other hot combustion products which pass through the heat shield apertures 483 and the nozzle apertures 473 and through the thin sleeve 485 to cut or burn a window or opening 605 through the casing 603. After the window is formed, the apparatus 421 is removed from the borehole 601 and casing 603 by winding the cable 18 around the reel of uphole equipment 611.

Figure 9:
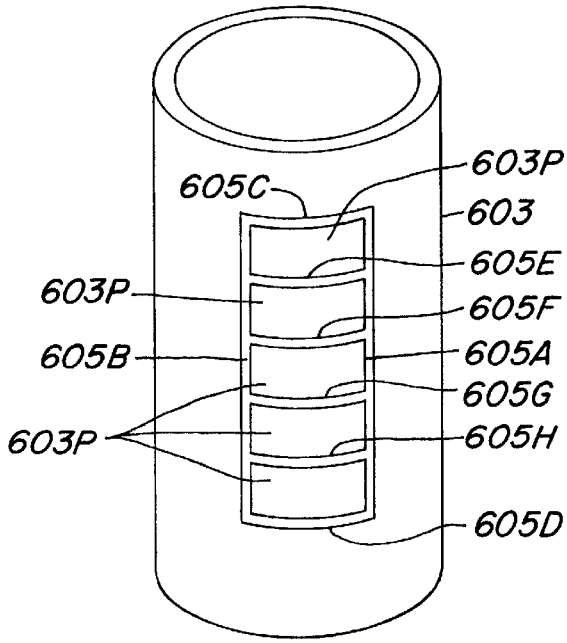
Figure 10:
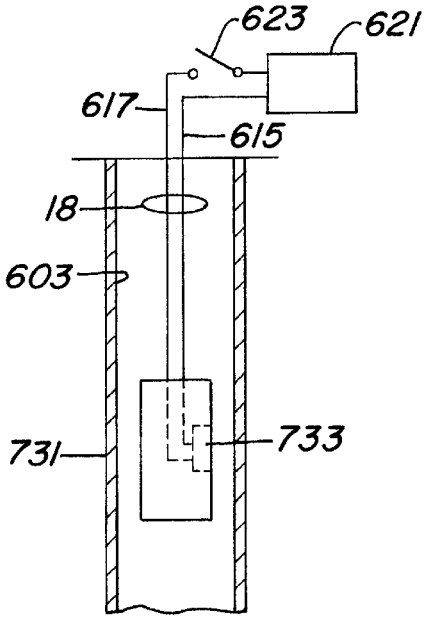
FIG. 10 is a schematic view of a borehole tool for removing the loose plug of FIG. 7.

Instead of forming the window 605 by burning through the wall of casing 603 in all areas within the window 605, the window 605 may be formed by forming the nozzle apertures 473 and 483 in a rectangular pattern to define the window as shown in FIGS. 8 and 9. In this embodiment, the nozzle apertures 473 and 483 will be located along two spaced apart vertical lines 673A and 673B and along two spaced apart horizontal lines 673C and 673D on one side of the axis 475. If the length of the window 605 to be formed is long, the nozzle apertures also 473 and 483 may be located along spaced apart intermediate horizontal lines 673E–673H as shown in FIG. 8. Referring to FIGS. 8 and 9, upon firing of the charges, slits or grooves will be formed through the wall of the casing 603 along lines 603A–603D surrounding a loose casing plug 603P or a plurality of plugs 603P if the nozzle apertures 673E–673H are used which then is/are removed by removing the apparatus 421 from the borehole and lowering a tool down the borehole with a junk basket or an electromagnet. Referring to FIG. 10, a tool 731 having an electro-magnet 733 coupled to the uphole electrical source 621 is lowered in the borehole 601 to the level of the window 605. The switch 623 is closed to energize the electromagnet 733 to attach and pull the plug 603P or plugs 603P from the window 605 and which is/are removed from the borehole by removing the tool 731.

Instead of forming a rectangular window 605, the nozzle apertures 473 and 483 may be arranged for example in a circle to form a circular window 605.

As mentioned above, the window 605 may be formed through the wall of the casing 603 to provide access to the formation from the borehole 601 for the recovery of petroleum through the window 605.

The apparatus of the invention also may be used to cut a window through metal production tubing, coiled metal tubing or metal drill pipe in a borehole.

The invention may be used as a window cutter for casing or casing liner where the initial cement job was poorly performed such that little or no cement exists between the casing outside diameter and the formation wall. A poor cement job allows for migration of well fluids in the annular cavity behind the casing. The invention allows for the formulation of a large defined opening in the casing wall for transport of cement through the window and into the annular cavity filling the void.

The invention also may be used as a window cutter for drill pipe/drill collars to form a large window so that fluid circulation may be established above the drill bit and at or below a stuck point. The large window will allow the operator to pump a high volume of fluid through the window and up the annular side of the drill pipe flushing the annulus between the drill pipe and the formation wall. Once circulation is established, the drill pipe can be freed and removed from the well, thus eliminating an expensive fishing job.

In another embodiment, a slickline battery firing system may be employed in lieu of the electric line firing system to energize the ignition means 44. This system comprises a slickline cable connection for supporting the modified apparatus 421 and which is connected to a pressure firing head.

The pressure firing head comprises a metal piston having a larger diameter head with a smaller diameter metal rod extending downward from the bottom of the larger diameter head. The piston is slidably located in a hollow cylinder. A spring surrounding the rod is employed to provide upward pressure against the under side of the larger diameter head. The spring is adjustable to allow for hydrostatic compensation of well fluids so that the system does not fire at bottom hole pressure. When the piston is moved downward the lower end of the rod will make contact with an electrical lead from the battery pack and an electrical lead coupled to one side of the ignition means (the minus terminal of the battery pack and the other side of the ignition means 44 are grounded) to discharge current to the ignition means to ignite the material 580 and fire the combustible charges 578. Fluid ports extend through the wall of the cylinder above the larger diameter piston head. When the borehole apparatus is in place in the borehole ready to cut the metal conduit to form an opening therethrough, a pump at the surface increases the fluid pressure in the conduit and moves the piston downward against the pressure of the spring to allow the rod to make electrical contact with the leads to fire the combustible charges 578.

In still another embodiment, a slickline percussion firing system may be employed in lieu of the electric line firing system to ignite the charges 578. This system comprises a slickline cable head connection connected for supporting the modified apparatus 421 and which is connected is to a pressure firing subassembly. The pressure firing subassembly comprises a cylinder having the piston and spring described in connection with the battery firing system. Ports are formed through the cylinder wall above the piston. Fluid pressure is increased to force the piston rod (firing pin) against a lower percussion firing cap which ignites upon impact to ignite the charges 578.

Also a coiled tubing percussion firing system may be employed in lieu of the electric line firing system to ignite the charges 578. This system comprises coiled tubing for supporting the modified apparatus 421 connected to a connector subassembly which connects to a pressure firing head which comprises a hollow cylinder which supports an interior piston by shear pins. The coiled tubing is coupled to the interior of the cylinder at its upper end. The piston has a central flow path extending axially downward from it supper end and then radially outward through the cylinder wall. A firing pin extends from the lower end of the piston. The flow path allows the coiled tubing to fill with water as the assembly is lowered in a downhole and also allows for circulation of fluid in running of the assembly. When the apparatus is at the desired cutting depth, a ball is dropped into the coiled tubing which passes to the piston, plugging the flow path allowing an increase in fluid pressure to be achieved in the coiled tubing and cylinder which shears the shear pins driving the firing pin into a percussion cap to ignite the charges 578.

Preferably the charges 578 are located above the nozzle apertures 473; at the level of the nozzle apertures 473; and below the nozzle apertures 473 to provide a balanced force when the charges 578 are ignited. This arrangement also provides more heat and force for forming a wide and long window 605 in the casing 603.

In the event that the window 605 to be formed is relatively narrow and short, the charges 578 may be located, above the apertures 473 only, above and at the level of the apertures 473 only, at the level of the apertures 473 only, at the level of and below the apertures 473 only, or below the apertures 473 only. For forming a narrow window, only one or two rows A or A plus B of apertures 473 and 483 may be formed through the wall 471 of the nozzle subassembly 433 and through the heat shield 481. The charges 578 may be located above the apertures 473 only by forming an annular shoulder on the inside wall 432 of the member 431 at its lower end 411 and stacking the charges upward from the shoulder to the ignition means 44. The charges 580 may be located above and at the level of the apertures 473 only by forming an annular shoulder on the inside of the wall 471 just below the apertures 473 and stacking the charges 578 upward from the shoulder to the ignition means 44. The charges 578 may be located at the level of the apertures 473 only by forming an annular shoulder on the inside of the wall 471 below the apertures 473 and dispensing with the use of the member 431; stacking the charges 578 from the shoulder to the upper level of the apertures 473; and screwing the end 34E of the member 34 into the upper open end of the member 433. The charges 578 may be located at the level of and below the level of the apertures 473 only by dispensing with the use of the member 431; stacking the charges from the top 515T of the plug 515 up to the upper level of the apertures 473; and screwing the end 34E of the member 34 into the upper open end of member 433. When the electric line firing system is used, the charges may be located below the apertures 473 only by dispensing with the use of the member 431; stacking the charges upward from the top 515T of the plug 515 to the lower level of the apertures 473; and locating the ignition system 46, 48, 50, 42, 44 at the bottom of the chamber 435 and with the ignition means 44 facing upward next to the lower end of the charges 578; and coupling the anchor subassembly 16 to the upper end of member 433. The leads 615 and 617 will extend through the apertures 578A of the charges 578 to the ignition means 44.

In one embodiment, the member 431, 433, and 435 each may have an outside diameter of 3½ inches. The nozzle apertures 473 and 483 each may have a diameter of ¼ inches. For the embodiment of FIG. 2, for nine rows A–I, adjacent apertures 473 in each row may be spaced apart 0.400 of an inch and adjacent rows spaced apart 15° (0.400 of an inch). The length of the rows A–I may be 8 feet. It is to be understood that these specifications may vary. The apertures 473 each may have a diameter of 0.200".

For the embodiment of FIGS. 8 and 9, the two rows 673A and 673B of apertures 473 forming the long side of the rectangle may be spaced apart 8".

What is claimed is:

1. An apparatus for cutting an opening through the wall of a metal conduit located in a borehole traversing the subsurface formations, comprising:

a body adapted to be lowered into the metal conduit, said body comprising a surrounding wall defining an elongated chamber, a plurality of spaced apart outer apertures formed through said surrounding wall along a length thereof, said surrounding wall having an inner side and a central axis, a heat shield wall located next to said inner side of said surrounding wall along said length and surrounding an inner zone, a plurality of spaced apart inner apertures formed through said heat shield wall in alignment with said plurality of spaced apart outer apertures, wherein said inner and outer apertures are located in at least one elongated row which extends generally parallel to said axis, a combustible charge located in said inner zone, and an ignition means located in said chamber close to said inner zone for igniting said combustible charge for creating hot combustion products for passage through said inner and outer apertures for forming the opening through the wall of the metal conduit.

2. The apparatus of claim 1, wherein:

said combustible charge is located in said inner zone at positions above, at the level of, and below said apertures.

3. The apparatus of claim 1, wherein:

the at least one elongated row comprises a plurality of elongated spaced apart rows on one side of said surrounding wall and said heat shield wall and generally parallel to said axis.

4. The apparatus of claim 3, wherein:

said combustible charge is located in said inner zone at positions above, at the level of, and below said apertures.

5. The apparatus of claim 1, wherein:

said surrounding wall of said body has a central axis, said inner and outer apertures define a pattern which encloses a given configuration on one side of said surrounding wall and said heat shield wall.

6. The apparatus of claim 5, wherein:

said combustible charge is located in said inner zone at positions above, at the level of, and below said apertures.

7. The apparatus of claim 1, wherein:

said surrounding wall has an outer side, a thin outer wall located next to said outer side of said surrounding wall and surrounding said outer apertures, said outer wall having an upper end and a lower end located above and below said outer apertures respectively, means for forming seals between said upper and lower ends of said outer wall and said outer side of said surrounding wall to prevent liquid in the borehole from entering said apertures, said flame and combustion products being capable of passing through said outer wall for forming an opening through the wall of the metal conduit.

8. The apparatus of claim 7, wherein:

said outer side of said surrounding wall is cylindrical in shape having a smaller outside diameter, in the vicinity of said outer apertures, than at the positions of said seals such that a space exists between said smaller diameter portion and said outer wall.

9. The apparatus of claim 1 wherein:

said surrounding wall is formed of metal, said heat shield wall is formed of a non-metallic material.

10. The apparatus of claim 9, wherein:

said heat shield wall is formed of carbon.

11. A method of cutting an opening through the wall of a metal conduit located in a borehole traversing the subsurface formations of the earth, comprising the steps of:

lowering into said metal conduit an apparatus comprising a surrounding wall defining a chamber having a central axis and a heat shield wall dispose proximate an interior surface of the surrounding wall, said chamber of said apparatus having a plurality of stacked combustible charges located therein and a plurality of spaced apart apertures formed through said wall of said apparatus along a line which encloses a given configuration with said charges being located in said chamber above, at the level of, and below said apertures, and igniting said combustible charges to create a flame and hot combustion products for passage through said apertures for forming an opening through the wall of the metal conduit corresponding to said given configuration.

12. A method of cutting an elongated opening through the wall of a metal conduit located in a borehole traversing the subsurface formations of the earth, comprising the steps of:

lowering into said metal conduit an apparatus comprising a surrounding wall defining a chamber having a central axis, said chamber of said apparatus having a plurality of stacked combustible charges located therein and a plurality of spaced apart apertures formed through said wall of said apparatus along a generally straight line generally parallel to the axis of said wall of said apparatus, with said charges being located in said chamber above, at the level of, and below said apertures, and igniting said combustible charges above, at the level of, and below said apertures to create a flame and hot combustion products for passage through said apertures for forming an opening through the wall of the metal conduit along the line defined by said apertures.

13. An apparatus for forming an opening through a wall of a metal conduit disposed in a borehole, comprising:

a body adapted to be lowered into the metal conduit, the body comprising a surrounding wall defining a chamber and having a central axis;

a plurality of apertures formed through a portion of the surrounding wall along a generally straight line generally parallel to the axis of the surrounding wall;

a heat shield wall located next to an interior surface of the surrounding wall;

a plurality of apertures formed through the heat shield wall and aligned with the plurality of apertures of the surrounding wall;

one or more combustible charges disposed within the chamber; and an ignition member for igniting the one or more combustible charges, whereby hot combustion products are formed for passage through the plurality of apertures of the heat shield wall and the surrounding wall, thereby forming the opening through the wall of the metal conduit.

14. The apparatus of claim 13, wherein the one or more combustible charges are disposed at positions above, at the level of, and below the plurality of apertures of the surrounding wall.

15. The apparatus of claim 13, wherein the plurality of apertures of the surrounding wall are formed on one side of the surrounding wall.

16. The apparatus of claim 15, wherein the one or more combustible charges are disposed at positions above, at the level of, and below the plurality of apertures of the surrounding wall.

17. The apparatus of claim 13, further comprising:

an outer wall disposed next to an exterior surface of the surrounding wall and surrounding the plurality of apertures of the surrounding wall; and a plurality of seal members disposed between the outer wall and the surrounding wall to prevent liquid in the borehole from entering the plurality of apertures of the surrounding wall, wherein the combustion products are capable of passing through the outer wall for forming the opening through the wall of the metal conduit.

18. The apparatus of claim 17, wherein the plurality of apertures of the surrounding wall are in fluid in communication with an annular space formed between the surrounding wall and the outer wall.

19. The apparatus of claim 13, wherein the surrounding wall comprises a metal and the heat shield wall comprises a non-metallic material.

20. The apparatus of claim 19, wherein the heat shield wall comprises carbon.

21. An apparatus for cutting an opening through a wall of a metal conduit located in a borehole traversing the subsurface formations, comprising:

a body adapted to be lowered into the metal conduit, said body comprising a surrounding wall along a length thereof, said surrounding wall having an inner side and a central axis, a heat shield wall located next to said inner side of said surrounding wall along said length and surrounding an inner zone, a plurality of spaced apart inner apertures formed through said heat shield wall in alignment with said plurality of spaced apart outer apertures, a combustible charge located in said inner zone at positions above , at the level of, and below said apertures, and an ignition means located in said chamber close to said inner zone for igniting said combustible charge for creating hot combustion products for passage through said inner and outer apertures for forming the opening through the wall of the metal conduit.

22. An appartus for cutting an opening through a wall of a metal conduit located in a borehole traversing the subsurface formation, comprising:

a body adapted to be lowered into the metal conduit, said body comprising a surrounding wall defining an elongated chamber, a plurality of spaced apart outer apertures formed through said surrounding wall along a length thereof, said surrounding wall having an inner side and a central axis, a heat shield wall located next to said inner side of said surrounding wall along said length and surrounding an inner zone, a plurality of spaced apart inner apertures formed through said heat shield wall in alignment with said plurality of space apart outer apertures, wherein said inner and outer apertures are located in a plurality of elongated spaced apart rows on one side of said surrounding wall and said heat shield wall and generally parallel to said axis, a combustible charge located in said inner zone, and an ignition means located in said chamber close to said inner zone for igniting said combustible charge for creating hot combustion products for passage through said inner and outer apertures for forming the opening through the wall of the metal conduit.

23. The apparatus of claim 22, wherein said combustible charge is located in said inner zone at positions above, at the level of, and below said apertures.

* * * * *

UNITED STATES PATENT AND TRADEMARK OFFICE

CERTIFICATE OF CORRECTION

PATENT NO. : 6,971,449 B1
APPLICATION NO. : 09/304653
DATED : December 6, 2005
INVENTOR(S) : Robertson It is certified that error appears in the above-identified patent and that said Letters Patent is hereby corrected as shown below:

On the Title Page

Item (56), References Cited, U.S. PATENT DOCUMENTS: Please include the following references:

| | | | |
|---|---|---|---|
| 2,649,046 | 8/1953 | Davis | 102/310 |
| 4,534,423 | 8/1985 | Regalbuto | 175/4.6 |

Column 8, Claim 12: replace the claim with the following:

--A method of cutting an opening through a wall of a metal conduit disposed in a borehole, comprising:

lowering an apparatus into the metal conduit, the apparatus comprising:

a surrounding wall defining a chamber having a central axis;

a plurality of combustible charges located therein;

a plurality of spaced apart apertures formed through a portion of the surrounding wall along a generally straight line generally parallel to the axis of the surrounding wall; and a heat shield wall disposed proximate to an inner side of the surrounding wall along the line defined by the plurality of spaced apart apertures and surrounding an inner zone; and igniting the plurality of combustible charges to create hot combustion products for passage through the plurality of spaced apart apertures for forming an opening through the wall of the metal conduit along the line defined by the plurality of spaced apart apertures.--

Column 9, Claim 18, Line 13: After “fluid”, delete “in”

Column 9, Claim 21, Line 26: Change “along a length thereof,” to --defining an elongated chamber,--

UNITED STATES PATENT AND TRADEMARK OFFICE

CERTIFICATE OF CORRECTION

PATENT NO. : 6,971,449 B1
APPLICATION NO. : 09/304653
DATED : December 6, 2005
INVENTOR(S) : Robertson It is certified that error appears in the above-identified patent and that said Letters Patent is hereby corrected as shown below:

Column 9, Claim 21, Line 27: Before "said surrounding wall having an inner side and a central axis", insert --a plurality of spaced apart outer apertures formed through said surrounding wall along a length thereof,--

Column 9, Claim 21, Line 37: Delete the space after "above"

Column 10, Claim 22, Line 6: Change "appartus" to --apparatus--

Column 10, Claim 22, Line 9: Change "formation" to --formations--

Column 10, Claim 22, Line 23: Change "space" to --spaced--

Signed and Sealed this

Twenty-seventh Day of March, 2007

JON W. DUDAS
*Director of the United States Patent and Trademark Office*